United States Patent [19]

Mårtensson

[11] 4,126,263

[45] Nov. 21, 1978

[54] PACKING CONTAINER PROVIDED WITH OPENING ARRANGEMENT

[75] Inventor: Kjell H. Mårtensson, Malmö, Sweden

[73] Assignee: Tetra Pak International AB, Lund, Sweden

[21] Appl. No.: 808,689

[22] Filed: Jun. 21, 1977

[30] Foreign Application Priority Data

Jul. 8, 1976 [SE] Sweden ..... 7607804

[51] Int. Cl.[2] ..... B65D 5/72; B65D 5/70

[52] U.S. Cl. ..... 229/17 R; 206/605

[58] Field of Search ..... 206/605, 610, 632; 229/17 R

[56] References Cited

U.S. PATENT DOCUMENTS

| | | | |
|---|---|---|---|
| 3,185,377 | 5/1965 | Moore | 229/17 R |
| 3,347,444 | 10/1967 | Rausing et al. | 229/17 R |
| 3,613,986 | 10/1971 | Christensson | 229/17 R |
| 3,650,458 | 3/1972 | Rausing | 229/17 R |
| 3,658,238 | 4/1972 | Nedstedt | 206/605 |
| 3,768,719 | 10/1973 | Johnson | 229/17 R X |
| 3,795,359 | 3/1974 | Rausing | 229/17 R |

*Primary Examiner*—Davis T. Moorhead

*Attorney, Agent, or Firm*—Burns, Doane, Swecker & Mathis

[57] ABSTRACT

An opening arrangement for packing containers made from laminated layers of plastic and paper in which a rectangular part of the top wall and an adjacent side wall is completely removable. A rectangular cover strip is sealed along its border portions to the inside of the top wall and adjacent side wall outside of the border portions of the removable rectangular part, and is also sealed to the removable rectangular part within its border portions at two spaced apart areas, which, when removed with the rectangular part, establish a pour opening having one edge coincident with an edge line formed between the top and side walls, and a vent opening. The cover strip is also provided with a folded portion projecting outwardly from this edge which forms a ledge over which the liquid goods within the container can flow so as to form a uniform and well defined jet.

5 Claims, 10 Drawing Figures

PACKING CONTAINER PROVIDED WITH OPENING ARRANGEMENT

Figure 1A:
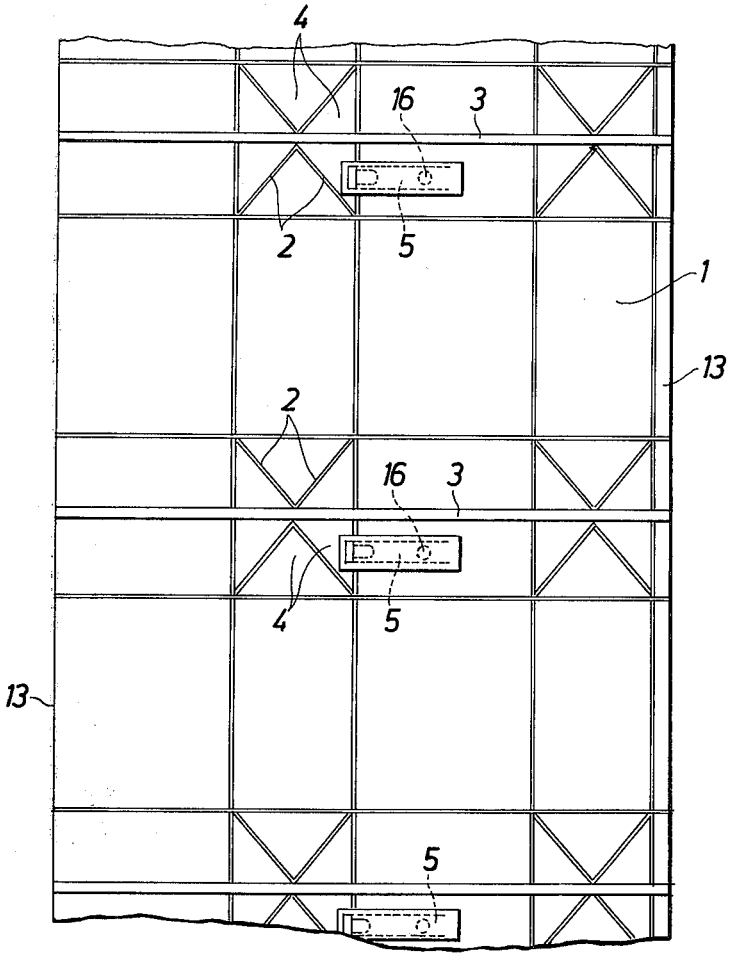

The present invention relates to a packing container provided with an opening arrangement which includes a punched-out or peripherally perforated portion in the wall of the packing container which can be lifted to either completely remove it or set it aside by folding thereby exposing an opening in the container wall. In addition a cover strip is attached to the inside of the packing container, fully covering the said punched-out portion. The cover strip is sealed to the inside of the packing container around the perforated portion, and is sealed to at least one part of the inside of the perforated portion that can be removed or set aside. In this manner a fusing together between parts of the cover strip and parts of the said portion is brought about.

It is customary at present to use packages of one-way character for many goods, e.g., liquid goods like milk and other dairy products, fruit juices, mineral water etc. The demands made on such consumer packages are that they should be cheap, easy to distribute, easy to handle and easy to open, so that the contents can readily be made accessible when desired.

A large group of these one-way packages, e.g. those used for milk and fruit juice, consists of a rigid carrier layer of paper or cardboard, which on at least one side has a covering of a plastic material to give the package the required imperviousness to liquids and other necessary barrier characteristics, e.g. imperviousness to gases. At the same time, the plastic material makes possible tight and durable sealing joints, since the combined layers of plastic material are heated up and at the same time are pressed together so that a fusing together of the combined plastic layers is obtained. Since most packages of this type will come into contact with a moist environment during handling, it is customary for the outsides of the packages also to have a plastic layer which prevents moisture from entering the fibrous carrier layer. If the carrier layer becomes moist, mechanical rigidity is lost thus causing the packages to have a soft feel and be unhandy.

One-way packages of the abovementioned type can be manufactured to-day in high-capacity packing machines where the contents are also handled in a hygienic manner. With these machines previously sterilized goods can be packed under aseptic conditions in such a manner that the goods retain their sterility in the closed package over a very long period. The problem with the abovementioned packages has always been the creation of an opening arrangement which is convenient to handle and which functions well, i.e., it should be easy to open the packing container without the use of a tool such as e.g. scissors, and the emptying opening produced shall given an even and well-defined jet of contents when they are poured from the package.

The known opening arrangements have consisted up to now of some form of perforation which extends through the outer plastic layer of the packing container and the carrier layer, whilst by contrast the inner plastic layer of the packing container is kept intact one demand on such an opening arrangement is that it should naturally be easy to rip open when the package is to be opened, but it should not be liable to be ripped up during normal handling and transport of the package. It will readily be seen that these two demands are controversial, since great safety against tearing up during the handling of the package implies that the package wall should not be excessively weakened which in turn means that more force is required for tearing up the package wall when the package is to be opened. It has also been found that perforations of the above-mentioned type, among other things, give rise to small leakages, which may not be so great that liquid can leak out, but which are great enough to allow bacteria to enter the packages and to infect the sterile contents. Other types of known opening arrangements consist of cover strips or so-called pull tabs, which can be torn off and which are arranged to cover previously punched-out holes in the packing container. Among other things, these holes are covered by means of a cover strip attached along the inside of the package, so that the liquid contents cannot come into contact with the absorbent cut surface in the punched-out emptying hole. Such emptying openings, which are made in principle with tear-off cover strips, are as a rule convenient to open. On the other hand, packages with opening arrangements of this type have poor pouring characteristics because the jet of contents often has to run over a frayed and uneven plastic edge formed when the inner cover strip is ripped up by the outer cover strip along an area within which the two cover strips are sealed to each other.

The disadvantages inherent in the known opening arrangements are overcome with the help of the opening arrangement in accordance with the invention, which is characterized by an inner cover strip of plastic; that covers the opening provided in the packing container wall, has a preferably sealed-up fold along the side of the cover strip facing the said opening. The fold is located so that it extends over the whole width of the opening, near the abovementioned sealed-up area between the cover strip and the portion of the packing container wall which can be removed or set aside.

Figure 1B:
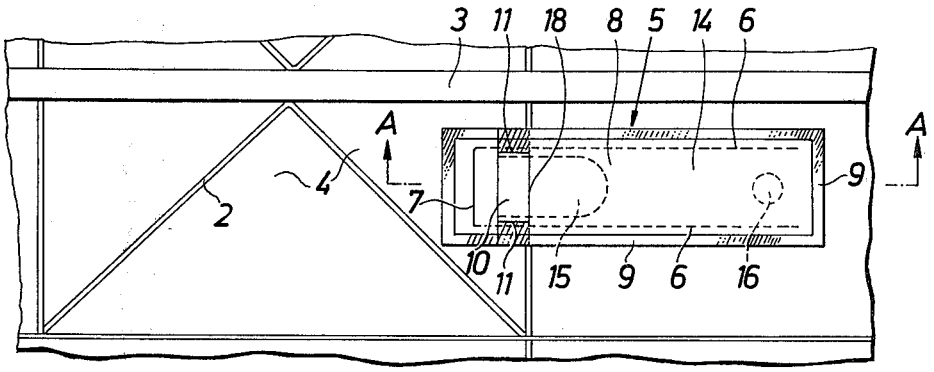
Figure 1C:
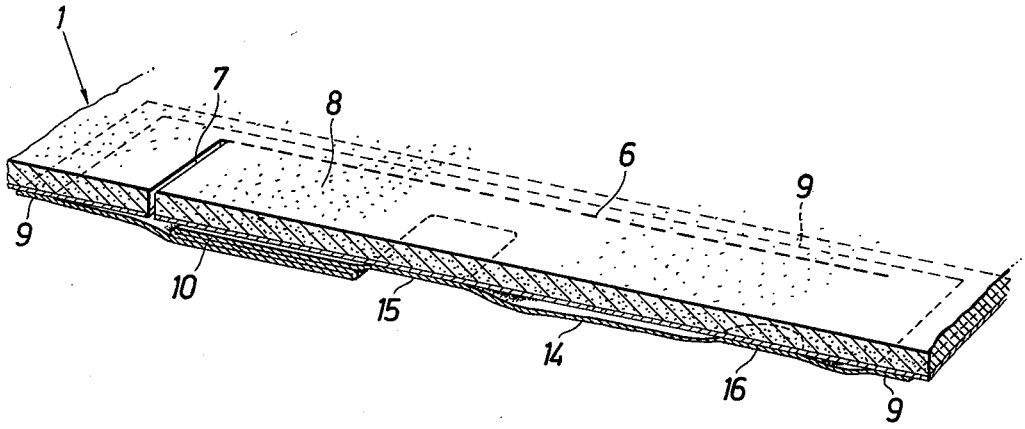
Figure 1D:
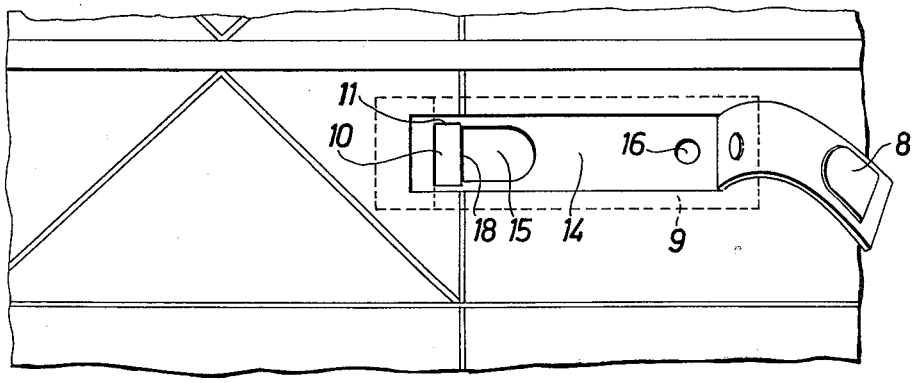
Figure 2A:
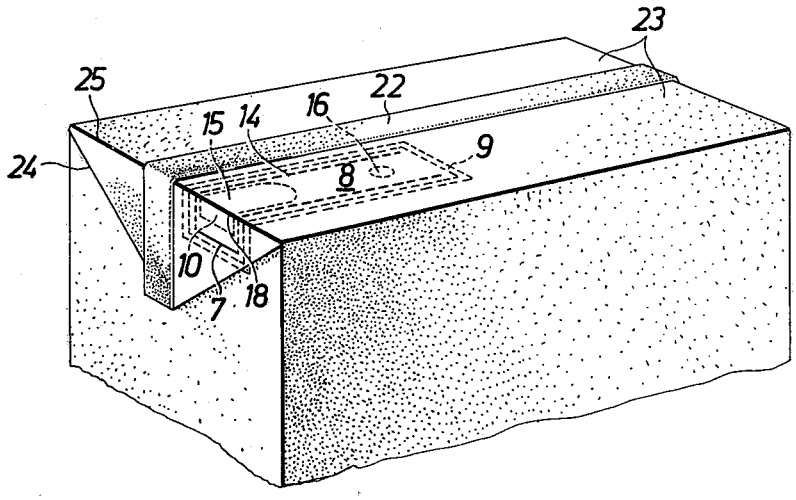
Figure 2B:
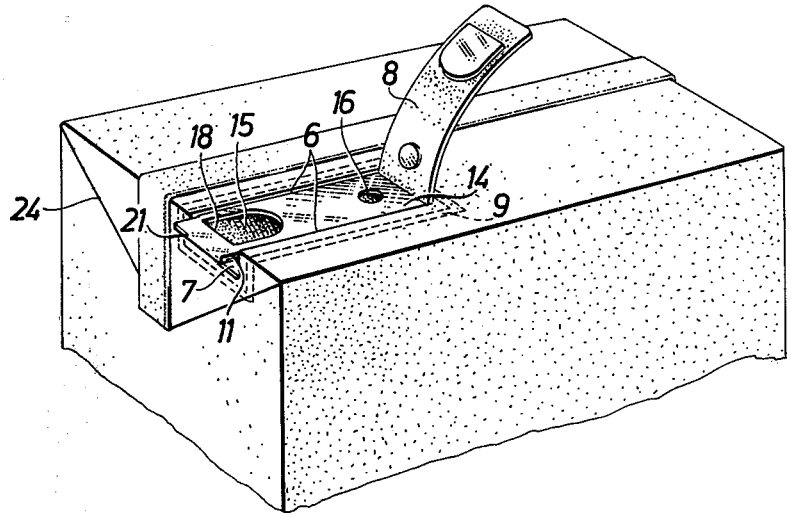
Figure 3A:
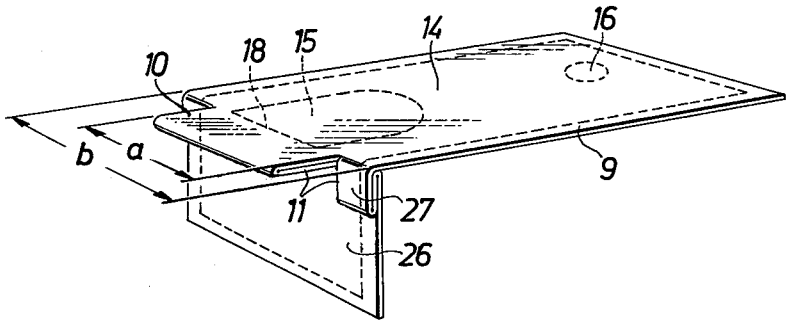
Figure 3B:
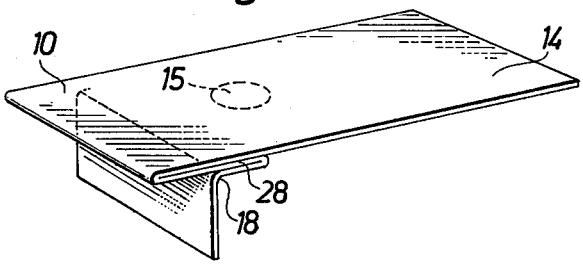
Figure 3C:
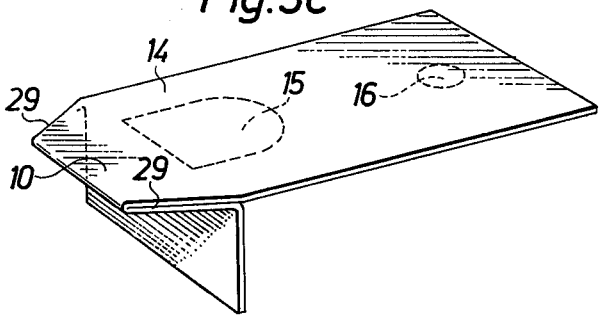
Figure 4:
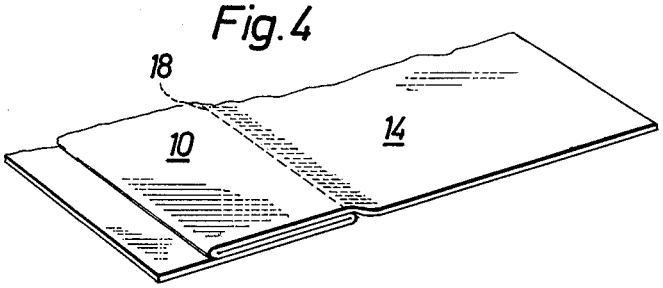

In the following the invention will be described with reference to the enclosed schematic drawing, in which FIG. 1*a* shows a packing material web which is provided with the opening arrangements in accordance with the invention, FIG. 1*b*, 1*c* and 1*d* show details of the opening arrangement fitted in the packing material web, FIG. 2*a* and 2*b* show part of the finished packing container provided with opening arrangement according to the invention, FIG. 2*a* showing the packing container unopened and FIG. 2b the packing container opened, FIG. 3 shows the inner cover strip forming part of the opening arrangement in different realizations, and FIG. 4 shows a web of material for this cover strip.

The packing material web in FIG. 1 is assumed in the present case to be constituted of a base layer of a foldable material, e.g. a fibrous material such as paper or cardboard, but the base layer may also consist of e.g. foamed plastics and here in particular polystyrene foam. The said base layer of the packing material has a covering of a thermoplastics impervious to liquid, preferably polythene, on at least the side of the packing material which is intended to form the inside of the packing container. In most cases the base layer is covered with thermoplastic material on both sides. To increase imperviousness to gas it may sometimes be necessary for the packing material also to comprise a gastight material, e.g. metal foil or a plastic material with good gas imperviousness characteristics.

The packing material web 1, which thus may consist of a number of materials laminated to each other, has a crease line pattern 2, 12 which facilitates the forming of the packing material by folding, first to a tube where the edge zones 13 of the packing material are joined together to form a tube, which tube is filled with the intended contents. The tube is divided in a known manner into individual packing units by successive flat pressings and transverse sealings along narrow sealing zones. In a subsequent forming process the packing containers obtain their final, in the present case parallelepipedic, form.

In the section of the packing material web 1 shown in FIG. 1 the triangular panels 4, delimited by crease lines 2, constitute the parts of the finished packing container which from triangular, double-walled lugs which project from the corners of the packing container which lugs are folded down against the side walls of the packing container and fixed to the same. The panels 3 constitute the areas which will form the said transverse sealing areas of the sealed tube and also the sealing fins which are encountered again on the finished package. The panels will extend over two of the side walls of the package and also over the said triangular lugs. The packing material web 1 is provided with an opening arrangement 5 applied to it in advance, which is shown in detail in FIG. 1*b*, 1*c* and 1*d*.

In FIG. 1*b*, which constitutes an enlarged view of a portion of FIG. 1*a*, the triangular panels 4 and the crease lines 2 delimiting the panels 4 can be seen again. Also visible is the sealing area which is designated 3. It is assumed that FIG. 1*b* is shown in such a manner that the side of the packing material which is intended to form the inside of the packing container faces the observer. The opening arrangement includes a cut which extends completely through the packing laminate, that is to say the base layer and the coating layers arranged on the base layer. This cut in the present case is formed by two parallel perforations 6 and a continuous cut 7. The cut numeral 7 may also be carried out as a perforation, but then preferably with sparser intervals between the non-perforated portions. The continuous cut shown in FIG. 1*b* thus forms a U, which has proved to be practical. However, it is possible to shape the cut in a number of different manners. Moreover, it is also possible to allow the cutting lines 6, 7 to close, so that a central area 8 of packing material is wholly enclosed by perforated lines. Over the said cut 6, 7 a cover strip of plastic material 14 is applied. The cover strip is provided with a fold 10 laid flat. The said cover strip 14 is sealed to the inside of the packing material along a sealing zone 9 closed in itself which sealing zone completely envelops the said cutting lines 6, 7. Thus the lines 6, 7 are wholly inside the sealing zone 9. As can be seen from FIG. 1*b* the opening arrangement 5 is located so on the packing material web that the cut part 7 will be located on the top side of one of the said double-walled triangular lugs, which originate during the forming of the packing container and which are formed by the panel 4 of the packing material web 1. The parallel cut perforations 6 will, in the present case, run parallel with the sealing zone 3 and extend substantially over the panel of the packing material 1 which will form the top side of the packing container. The said fold 10 of the inner cover strip 14 is located with the baseline 18 substantially along the crease line 17 of the packing material web 1, which forms the line of separation between the panel 4 that is intended to form the double-walled triangular lugs and the top end surface of the packing container. The said fold 10 of the cover strip 14 must be sealed together so that it forms a lug free of the cover strip 14. Since the cover strip 14 is sealed around it outer edge along the sealing area 9, the fold 10 too will be included in this sealing zone, which means that the fold is held laid down against the cover strip 14. However, since it is desirable that the fold 10 should constitute a pouring edge on the opening arrangement, it is provided with two cuts 11 which extend from the free edge of the fold as far as its baseline 18 or close to it, the distance between the cutting lines 11 corresponding to or being somewhat less than the distance between the parallel cut perforations 6. Inaddition to being sealed along the sealing zone 9, the cover strip 14 is sealed to the inner thermoplastic coating of the packing material web 1 along the areas 15, 16, the area 15 being located close to the baseline 18 of the fold 10, whilst the sealing area 16 is arranged at the greatest possible distance from the sealing area 15, but still within the cut area 8.

In FIG. 1*c* which is a section along line A—A of FIG. 1*b*, it is illustrated how the cover strip 14 of plastic material is sealed along the sealing joint 9 to the inside of the packing material 1. Also shown in the figure is the cut 7, cutting completely through the packing material, the perforation 6, and a part of the area 8 enclosed by the cuts 6, 7. The figure also indicates how the fold 10 of the cover strip 14 is arranged with the fold facing towards the inside of the packing material. Moreover it is shown that the cover strip 14 is sealed along the areas 15, 16 to the inside of the packing material along zones separated from one another, the zone 15 being located close to the base 18 of the said fold 10.

In FIG. 1*d* the opening arrangement 5 is shown lifted or ripped up. The part 8 of the packing material which is situated between the cutting lines 6, 7 having been ripped up, the sealed portions 15, 16 are broken away so that the holes 19, 20 have been revealed in the cover strip 14 to form a pouring opening and a so-called ventilation hole. The figure also shows how the fold 10 is exposed after the removal of the ripped up portion 8, the front part 21 forming a pouring lip for the contents that are poured out through the emptying hole 19. In FIG. 2*a* the upper part of a packing container is shown which has been manufactured by folding of the packing material in accordance with FIG. 1*a*. In FIG. 2*a* the upper end surface of the packing container is designated 23, and the sealing fin running along the upper end surface 23 is marked 22. The double-walled triangular lugs, mentioned earlier in the description, which during the folding operation are formed at the corners of the packing container, are designated 24. By contrast to FIG. 1, the opening arrangement of FIG. 2 is observed from the outside of the package, which means that the cover strip 14 is not directly visible but is marked by broken lines, as is also the sealing zone 9 of the cover strip. Visible from the outside, however, are the slit perforations 6, 7 and the portion 8 of the packing material located inside the said slit perforations. As can be seen from the figure, the slit 7 is not realized as a perforation but as a whole punchout cutting through the packing material, possibly with a few uncut, narrow portions remaining so as to prevent any unintentional breaking open of the opening arrangement. The perforations 6, however, are made up of repeated broken and unbroken portions of packing material and, as can be seen from the figure, the slit perforations 6, 7 form a continuous line.

Since the triangular lug 24 is folded down against the side wall of the packing container, the fold 10, which at its base coincides with the edge line 25, will be folded downwards against the side of the package together with the triangular lug 24. When the packing container is opened, which is illustrated in FIG. 2*b* where the material in the area 8 inside the perforation lines 6, 7 being ripped up, the cover strip 14 will be exposed within the opening in the package wall which results when the wall portion 8 is ripped up and removed. Since the cover strip 14 is sealed to the inside of the packing material along the portions 15, 16, the cover strip 14 will be ripped up within these portions, so that an emptying hole 19 and a so-called ventilation hole 20 are formed. Through the latter air is intended to flow in when the contents are poured out so as to compensate for the reduction in volume in the package which arises when the contents are poured out. The fold 10 of the cover strip 14, which has been cut up along the slit lines 11 up to or close to the base line 18 of the fold, will be freed when the wall portion 8 is removed, and due to its inherent elasticity it will be raised up to substantially the same plane as the upper end wall of the packing container to form a freely projecting edge 21 over which the contents can flow so as to form a uniform and well-defined jet.

As mentioned above, it is important that the part of the fold 10 folded over the side edge is raised up to substantially the same plane as the end wall in which the emptying hole 19 is arranged when the opening arrangement is torn open, since it is the function of the fold 10 to form an edge projecting from the packing container over which the contents can run without running down along the side of the package wall. Experience has shown that a liquid which is poured from an emptying hole is difficult to keep in an even well-defined jet if the liquid is poured over a rounded or otherwise inadequately defined edge. On the other hand, if the liquid is poured over a sharp or projecting edge, it flows in an even jet which is easy to control. There is the further advantage that on stopping of the pouring operation drip formation is largely avoided. As mentioned above, it is a precondition for obtaining an even and well-defined jet when pouring out the contents that the pouring edge should project as a free, well-defined edge. In the present case the fused fold 10 acts as a pouring lip, the pouring edge being defined by the front edge 21 of the fold 10. By the very fact that the fold 10 is fused together so that it has a double material thickness it will also have an increased tendency to rise from its folded-down position when the wall lug 8 is ripped up. But it is of course also important that a suitable material, that is to say an elastic material, is chosen for the cover strip 14. Such materials are e.g. polyethylene, polypropylene, polyester, and it has been found that especially good results are obtained with the help of thin foamed plastic films of polystyrene and polyethylene.

When applied and when the package is opened, the cover strip 14 itself will have the appearance as shown in FIG. 3*a*, where the folded down part of the cover strip is designated 26 and the projecting pouring lip 10. The parts of the fold 10 which are sealed firmly to the cover strip 14 besides along sealing zone 9 are marked 27, and the cut which separates the projecting fold 10 from the parts 27 is designated as previously by numeral 11. As can be seen from the figure, the total width of the cover strip 14 is designated b, and the width of the projecting fold lug 10 is marked a. As mentioned previously, the width b should be greater than the distance between the perforation lines 6 which define the width of the rip-up lug 8, whilst the width of the lug 10 should be smaller than the width of the rip-up lug 8, since the fold lug 10 should be able to project through the opening which is formed when the wall part 8 is ripped up.

To increase further the springiness and elasticity of the fold lug 10 it can be designed as a double fold in accordance with FIG. 3*b*. The stiff sealed-up portion 28, which comprises three layers of material and is arranged close to the base line 18 of the lug fold 10, contributing to an appreciable extent to an increase in the tendency of the fold lug 10 to rise up from its folded down position when the opening arrangement is ripped up.

In a further embodiment, which is shown in FIG. 3*c*, the fold 10 is not cut by the slits 11, but the corner portions 29 of the fold 10 are folded in or alternatively are cut off, so that the front part of the fold 10 becomes narrower than the total width of the fold 10, which means that at least part of the fold 10 can project through the opening which is formed when the wall portion 8 is removed.

The arrangement and the application of the cover strip 14 can be made relatively simple, since a web 14 provided with fold 10 in accordance with FIG. 4 can be manufactured in advance. The said web of plastic material being continuously advanced can be located over punchings for the slits 6, 7 made in an earlier working phase and sealed in a sealing joint closed in itself around the said slitted portion, so as to tighten the perforations of the packing material which have been produced in the punching operation of the slits 6, 7. The areas 15, 16 of the cover strip may be sealed at the same time to the inner plastic layer on the inside of the packing material web. After the location and sealing operation, or in connection therewith, a suitable piece of the continuous web of cover strip material can be cut off in accordance with FIG. 4, whereupon the front end of the web of cover strip material is located over the succeeding perforation punching. The fold 10 of the cover strip facing towards the packing material web can consequently be sealed together in an earlier phase, so that the cover strip material shown in FIG. 4 has an already sealed-up fold portion.

In the embodiment shown here it has been described how the opening arrangement in accordance with the invention is applied over a part of the double-walled triangular lugs 24, which are formed when the packing container is produced from a tube of packing material, which in turn is manufactured from a plane web of packing material. However, it is also quite feasable to arrange the opening arrangement 5 anywhere else on the packing container, but it is of course appropriate to arrange it on that part of the packing container which is intended to form its upper end face. It is also appropriate to arrange the opening arrangement so that the base line 18 of the wall lug 10 almost coincides with one of the edge lines of the packing container. It is also possible, if desired, to position the opening arrangement on a plane end face of the packing container, where it was found that the wall lug 10 will have a tendency of pointing obliquely upwards when the opening arrangement is ripped up, and a free pouring edge is formed therby which acts satisfactorily. The best result is obtained, however, if the wall lug 10 is located on the edge of the packing container.

It has been found that an opening arrangement in accordance with the invention will be relatively cheap and easy to produce in conjunction with the manufacture of packages in automatic packing machines of the type which has been described in the beginning. Naturally it is also possible to prepare the packing material in advance in such a manner, that it is provided with punch-outs and cover strip. In addition to being relatively cheap and easy to realize with good accuracy, the opening arrangement has proved to function reliably and to be readily usable.

I claim:

1. A packing container having a wall provided with an opening arrangement comprising a perforated portion in the wall of the packing container which is operable to be lifted so as to free an opening in the container wall, a cover strip attached to the inside of the packing container, fully covering the said perforated portion, sealed to the inside of the packing container around the said opening, and sealed to the inside of the portion of the packing container wall that can be lifted, so that a fusing together of material between parts of the cover strip and parts of the said portion is brought about wherein said cover strip has a sealed-up fold along a side of the cover strip which faces towards said opening, the fold extending over the whole width of the opening and constructed to rise from the container wall when exposed.

2. A packing container in accordance with claim 1, wherein said fold on the cover strip has two incisions which extend from the top of the fold near to a base line of the sealed-up fold, said incisions being limited to those parts of the said fold which are sealed up between the cover strip and the container.

3. An opening arrangement in accordance with claim 1, wherein said fold has a base line located along an edge of the packing container.

4. An opening arrangement in accordance with claim 1, wherein said fold is unattached to the cover strip and to the inside of the packing container wall, and wherein the fold has such elasticity that it will rise from the surface of the cover strip when the perforated portion of the packing container wall is lifted in connection with the opening of the packing container.

5. An opening arrangement in accordance with claim 1, wherein the cover strip is sealed to the perforated portion in two areas, one of which is smaller than the other, and wherein said areas are arranged to be ripped up so as to expose the inside of the packing container when the perforated portion of the packing container wall is lifted.

* * * * *